US009828793B2

(12) United States Patent
Shah

(10) Patent No.: US 9,828,793 B2
(45) Date of Patent: Nov. 28, 2017

(54) DOOR LATCH WITH LOW OPERATING NOISE

(71) Applicant: ARCHITECTURAL BUILDERS HARDWARE MFG., INC., Itasca, IL (US)

(72) Inventor: Ankit Kirti Shah, Chicago, IL (US)

(73) Assignee: ARCHITECTURAL BUILDERS HARDWARE MFG., INC., Itasca, IL (US)

( * ) Notice: Subject to any disclaimer, the term of this patent is extended or adjusted under 35 U.S.C. 154(b) by 293 days.

(21) Appl. No.: 14/534,714

(22) Filed: Nov. 6, 2014

(65) Prior Publication Data

US 2016/0130846 A1 May 12, 2016

(51) Int. Cl.

| | |
|---|---|
| ***E05C 1/06*** | (2006.01) |
| ***E05C 1/14*** | (2006.01) |
| *E05C 1/08* | (2006.01) |
| *E05B 17/00* | (2006.01) |
| *E05B 77/42* | (2014.01) |
| *E05B 77/36* | (2014.01) |

(52) U.S. Cl.

CPC ..... *E05C 1/14* (2013.01); *E05B 17/0045* (2013.01); *E05B 17/0041* (2013.01); *E05B 77/36* (2013.01); *E05B 77/42* (2013.01); *Y10S 292/56* (2013.01)

(58) Field of Classification Search

CPC ..... Y10S 292/56
USPC ..... 292/2, 137–193
See application file for complete search history.

(56) References Cited

U.S. PATENT DOCUMENTS 1,194,636 A * 8/1916 Joy ..... E05B 17/08 292/137
1,620,414 A * 3/1927 Vanderlip ..... E05B 83/243 292/101
2,029,711 A * 2/1936 Frantz ..... E05F 5/06 16/82
2,073,149 A * 3/1937 Geyer ..... E05B 77/40 292/1
2,125,655 A * 8/1938 Schlage ..... E05B 15/10 292/2
2,159,315 A * 5/1939 Blue ..... E05B 77/38 292/2
2,194,801 A * 3/1940 Lindstrom ..... E05B 65/025 292/83
2,823,941 A * 2/1958 Ellis ..... E05B 17/007 292/137
3,089,720 A * 5/1963 Schlage ..... E05B 15/10 292/169.19
3,153,552 A * 10/1964 Sandor ..... E05B 85/14 292/336.3
3,637,246 A * 1/1972 Leiter ..... E05C 19/06 292/303

(Continued)

*Primary Examiner* — Carlos Lugo
(74) *Attorney, Agent, or Firm* — Greer, Burns & Crain, Ltd.

(57) ABSTRACT

A door latch assembly is provided with enhanced acoustic dampening characteristics, and includes a door bolt assembly having an inside barrel and an outside barrel configured for accommodating reciprocal sliding action of the inside barrel between a latch position and a release position. At least one barrel acoustic isolator is associated with at least one of the inside barrel and the outside barrel, and is configured for dampening sound generated by the reciprocal action.

17 Claims, 8 Drawing Sheets

(56) References Cited

U.S. PATENT DOCUMENTS 4,007,954 A * 2/1977 Erickson ..... A62C 2/242 292/165
4,358,141 A * 11/1982 Hamada ..... E05B 85/243 292/216
4,482,179 A * 11/1984 Johnson ..... E05B 1/0038 292/336.3
4,896,908 A * 1/1990 Kleefeldt ..... E05B 81/66 292/216
4,986,583 A * 1/1991 Campbell ..... E05B 65/104 292/165
5,690,371 A * 11/1997 Turnbull ..... E05B 17/2092 292/163
5,730,478 A 3/1998 D'Hooge
5,862,570 A * 1/1999 Lezuch ..... E05C 17/085 16/82
6,196,599 B1 3/2001 D'Hooge
6,293,598 B1 9/2001 Rusiana
6,570,757 B2 * 5/2003 DiFonzo ..... G06F 1/1616 248/917
7,258,374 B2 8/2007 Rusiana
7,481,607 B2 1/2009 Rusiana et al.
7,677,614 B2 * 3/2010 Monig ..... E05B 85/16 292/336.3
7,841,632 B2 * 11/2010 Tracy ..... F16F 15/08 292/121
7,866,714 B2 * 1/2011 Monig ..... E05B 81/76 292/336.3
7,905,525 B2 * 3/2011 Badia ..... E05B 17/007 16/82
8,403,374 B2 * 3/2013 Shimizu ..... E05B 83/30 292/137
8,491,020 B2 * 7/2013 Lopes ..... B60D 1/60 292/1
8,807,607 B2 * 8/2014 Glickman ..... E05C 3/046 292/241
2009/0315342 A1 * 12/2009 Dalton, Jr. ..... E05B 63/006 292/197
2010/0253101 A1 * 10/2010 Seto ..... E05B 85/12 292/336.3
2012/0272697 A1 * 11/2012 Motherwell ..... B62J 1/28 70/258
2013/0076046 A1 3/2013 Shah et al.
2015/0021933 A1 * 1/2015 Shin ..... B60N 3/023 292/336.3

* cited by examiner

DOOR LATCH WITH LOW OPERATING NOISE

BACKGROUND

The present invention relates generally to door latch assemblies that include a door bolt assembly operable by a door handle assembly preferably having a paddle style handle. The handles are selectively positionable in either in up, down, horizontal left or horizontal right configurations. More specifically, the present disclosure relates to a door latch assembly configured to operate with relatively low operating noise.

Examples of existing door latch, door bolt, and door handle assemblies are described in U.S. Pat. Nos. 6,293,598; 7,258,374; 7,481,607; 6,196,599 and 5,730,478, and US Patent Publication No. 2013/0076046A1, all commonly assigned to Architectural Builders Hardware Manufacturing, Inc., and hereby incorporated by reference. Such door latch assemblies include, generally, a door bolt assembly with a latch mechanism, and at least one handle mechanism.

A common problem of conventional door latch and door handle assemblies is that they generate more than desired levels of noise over the ambient noise. In some environments, such levels of noise may be distracting. For example, in hospital work environments, the opening of a patient's room door by a nurse may unnecessarily wake the patient, thereby inhibiting patient rest. In addition, in an operating room environment, a surgeon may be unnecessarily distracted by the opening of a door during a delicate procedure, thereby causing the surgeon to lose focus. Ambient noise in typical hospital work environments is about 40-42 decibels (dB). A conventional door latch and door handle assembly may generate over 30 additional decibels of noise when a door is opened.

SUMMARY

Thus, there is a need for an improved door latch assembly with door bolt and door handle assemblies designed for operating with relatively low operational noise, particularly in hospital and medical environments. This need is addressed by the present door latch assembly, which features acoustic isolators located between selected components, thus dampening sound generated when these parts make contact with each other while opening and closing a door.

More specifically, a door latch assembly is provided with enhanced acoustic dampening characteristics, and includes a door bolt assembly having an inside barrel and an outside barrel configured for accommodating reciprocal sliding action of the inside barrel between a latched position and a released position. At least one barrel acoustic isolator is associated with at least one of the inside barrel and the outside barrel, and is configured for dampening sound generated by the reciprocal action.

In another embodiment, a door latch assembly is provided with at least one barrel acoustic isolator associated with at least one of the inside barrel and the outside barrel, and configured for guiding the inside barrel in the outside barrel when accommodating the reciprocal sliding action of the inside barrel to reduce contact between the inside barrel and the outside barrel, thereby dampening sound generated by the reciprocal action.

In still another embodiment, a door latch assembly is provided with enhanced acoustic dampening characteristics including a door bolt assembly having an inside barrel and an outside barrel configured for accommodating reciprocal sliding action of the inside barrel between a latch position and a release position. At least one barrel acoustic isolator is associated with at least one of the inside barrel and the outside barrel, and configured for dampening sound generated by said reciprocal action. In addition, an anvil plate is secured inside the inside barrel and having a finger-receiving surface. The door latch assembly preferably includes a door handle assembly having a finger and a door handle coupled to the finger such that the finger moves laterally along the axis of the inside barrel when the door handle is moved from a rest position to an actuating position. In addition, the door handle assembly includes a finger acoustic isolator secured around the finger to retain the finger when the door handle is in the rest position and configured for dampening sound generated by the finger moving laterally along the axis of the inside barrel. Further, the inside barrel is configured for receiving the finger of using the finger-receiving surface of the anvil plate.

In still another embodiment, a door latch assembly is provided enhanced acoustic dampening characteristics, includes a door bolt assembly including a latch cylinder having a latch cylinder opening and a reciprocating strike, and a door handle assembly. The door handle assembly has a finger and a door handle coupled to the finger such that the finger is moved in the latch cylinder opening when the door handle is moved from a rest position to an actuated position, the finger is configured for biasing the latch cylinder from a latch position to a release position. The door latch assembly is constructed and arranged to generate between 0.01 and 15 decibels over ambient noise.

DETAILED DESCRIPTION

Figure 1:
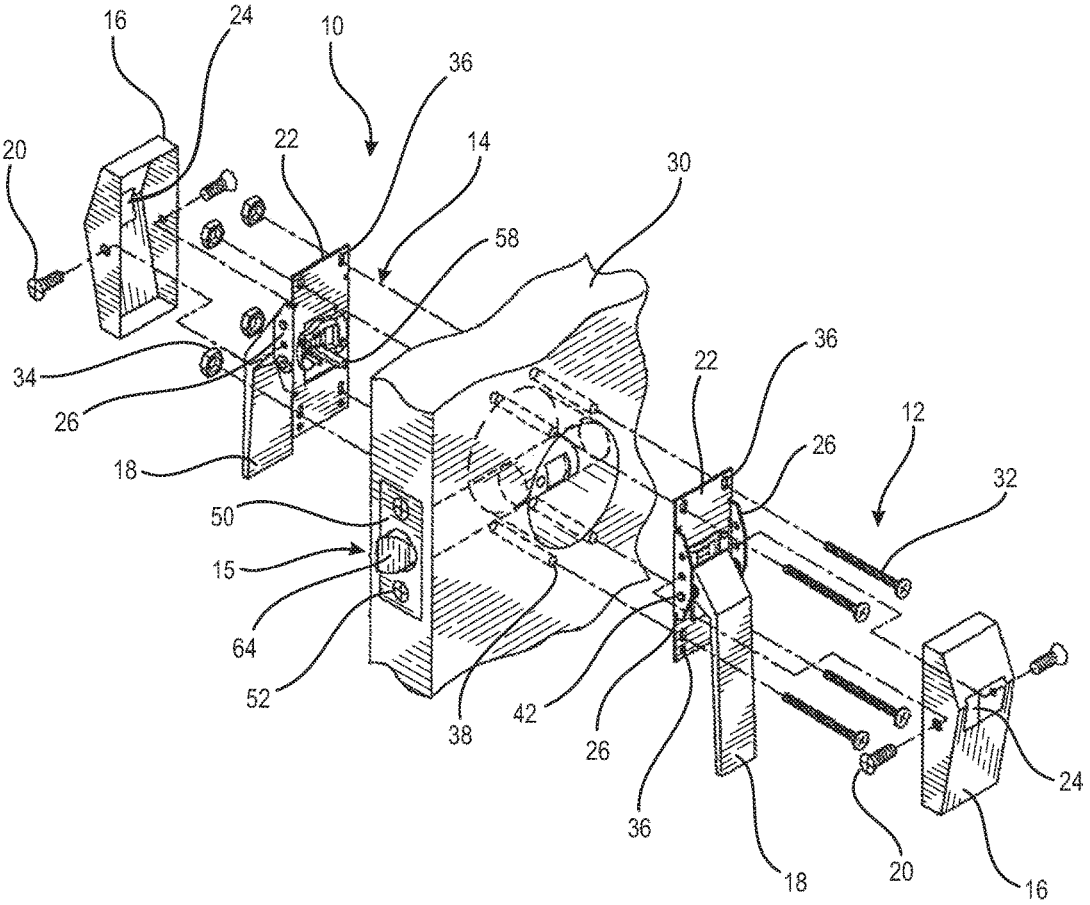
FIG. 1 is top exploded perspective view of the present door latch assembly shown mounted on a door.
Figure 3:
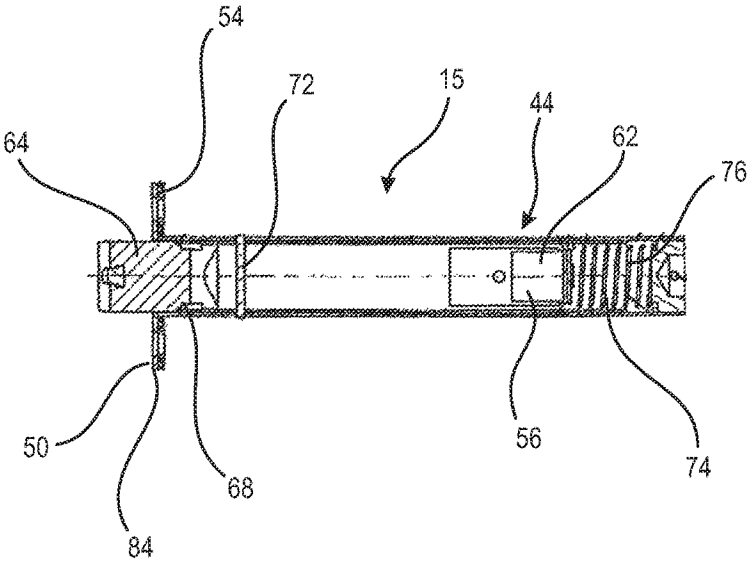
FIG. 3 is a vertical cross-section taken along the line 3-3 of FIG. 2 and in the direction generally indicated.
Figure 2:
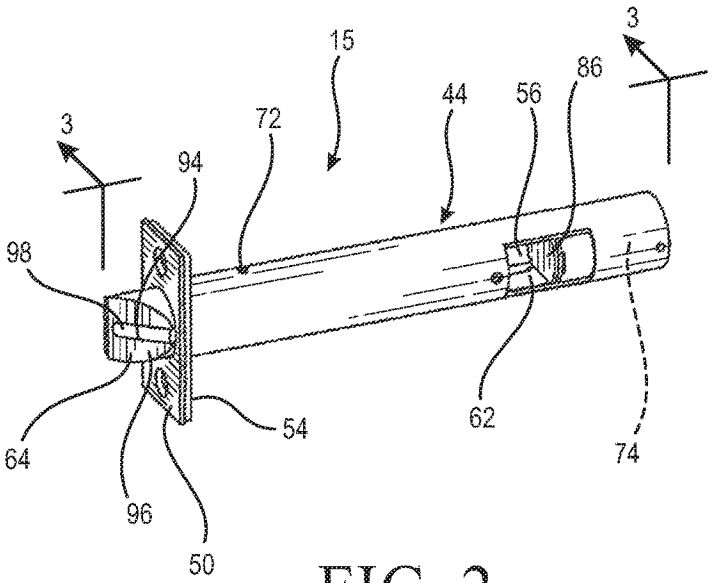
FIG. 2 is a side perspective view of the present door bolt assembly.
Figure 4:
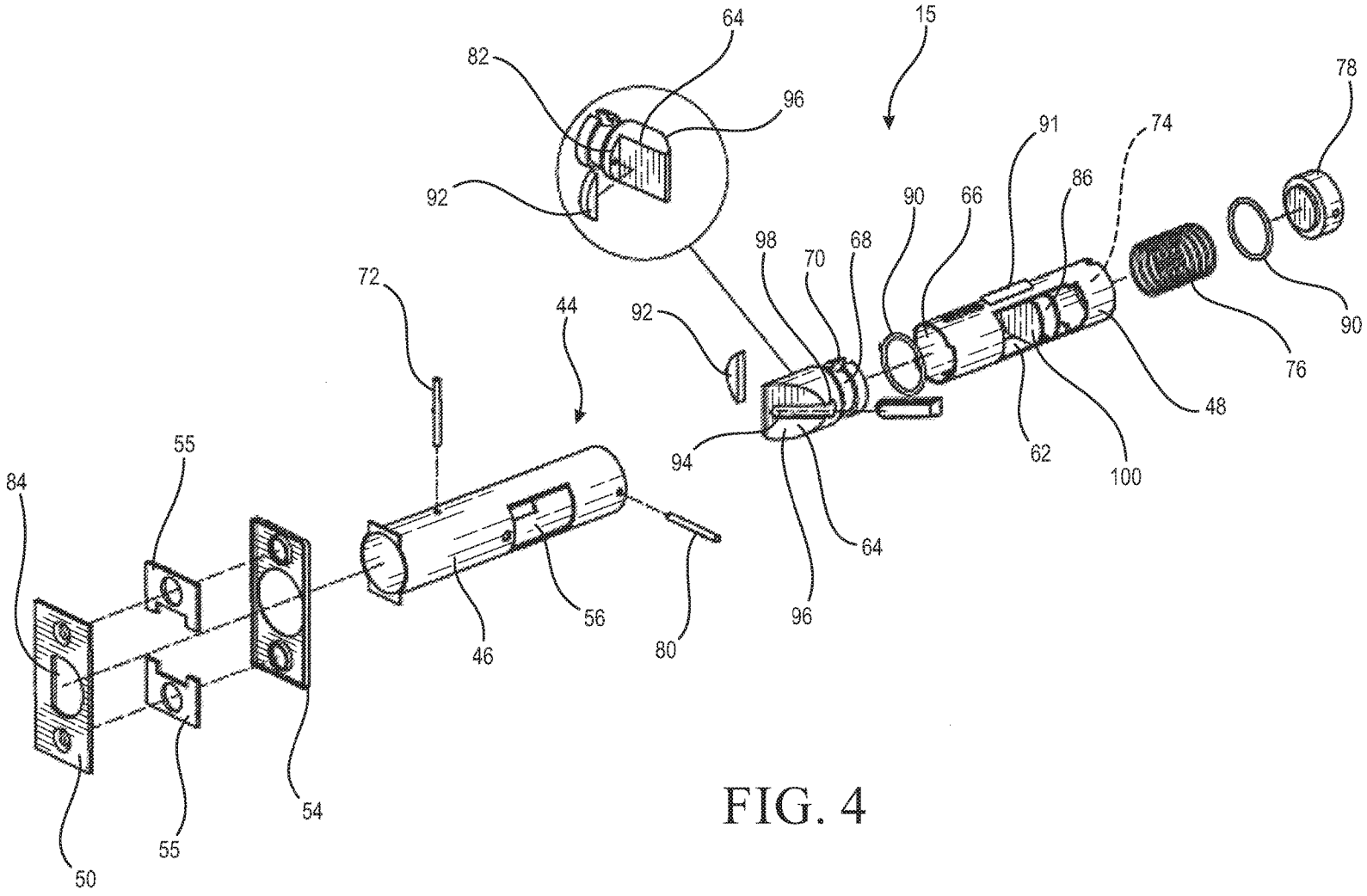
FIG. 4 is an exploded perspective view of the present door bolt assembly.

Referring now to FIG. 1, the present door latch assembly is shown and generally designated 10. The door latch assembly 10 includes door handle assemblies 12 and 14 as well as a door bolt assembly 15. Each door handle assembly 12, 14 is identical, and as such only one will be described in detail. Included in the door handle assembly 12 is a faceplate or cover plate 16, a door handle 18, and at least one faceplate fastener such as a screw 20 used for securing the faceplate to a mounting plate 22. Further, each faceplate 16 has a faceplate opening 24 that is configured to allow the door handle 18 to pass through for actuation by a user. FIG. 1 shows each faceplate opening 24 being rectangular in shape, however, persons of ordinary skill in the art would understand that other shapes are contemplated.

In addition, each faceplate 16 is secured to sidewalls 26 of the mounting plate 22 using the faceplate fasteners 20. Moreover, each door handle 18 is configured to be also pivotably secured to a corresponding mounting plate 22. Further, each door handle 18 is configured for movement between a rest position and an actuating position to open the door by actuating (lifting or pressing) the door handle about a pivoting point described below.

The door handle assemblies 12, 14 are secured to a door 30 by a plurality of mounting fasteners, such as bolts 32 and associated mounting nuts 34. Further, each mounting plate 22 has a plurality of mounting openings 36 configured for being in registry with associated mounting openings 38 on the door 30. The mounting bolts 32 are passed through the mounting plate openings 36 then through the door mounting openings 38 and the mounting openings of the other mounting plate. As is known in the art, the mounting bolts 32 are then secured using the mounting nuts 34.

A shaft 42 (Best seen in FIG. 5) is configured to pass through a selected pair of corresponding aligned openings in the sidewalls 26. The pivot pin 42 also passes through a complementary bore in the door handle 18 and maintains pivoting action and alignment of the door handle 18 relative to the mounting plate 22. A torsion spring (not shown) is located on the pivot pin 42 and is configured for returning the door handle 18 to the rest position when released. As is known in the art, he torsion spring is preferably U-shaped with coiled spring-shaped side portions, a horizontal bottom portions and a pair of legs. Each of the spring-shaped side portions is configured for wrapping around the pivot pin 42, on opposite sides of the door handle 18.

Referring now to FIGS. 1-4, while other configurations are contemplated, the door latch assembly 10 is preferably a so-called "low profile" design as is well known in the art. Included in the assembly 10 is the door bolt assembly 15 including a latch cylinder 44 made up of an outside barrel 46 and an inside barrel 48 reciprocating within the outside barrel between a latched and a released or retracted position. Also included on the outside barrel 46 is a dress plate 50 at one end of the cylinder. At least one dress plate fastener 52 passes through the dress plate 50 and an underlying back plate 54 for attaching the door bolt assembly 15 to the door 30. If desired, spacers 55 are located between the back plate 54 and the dress plate 50.

Figure 5:
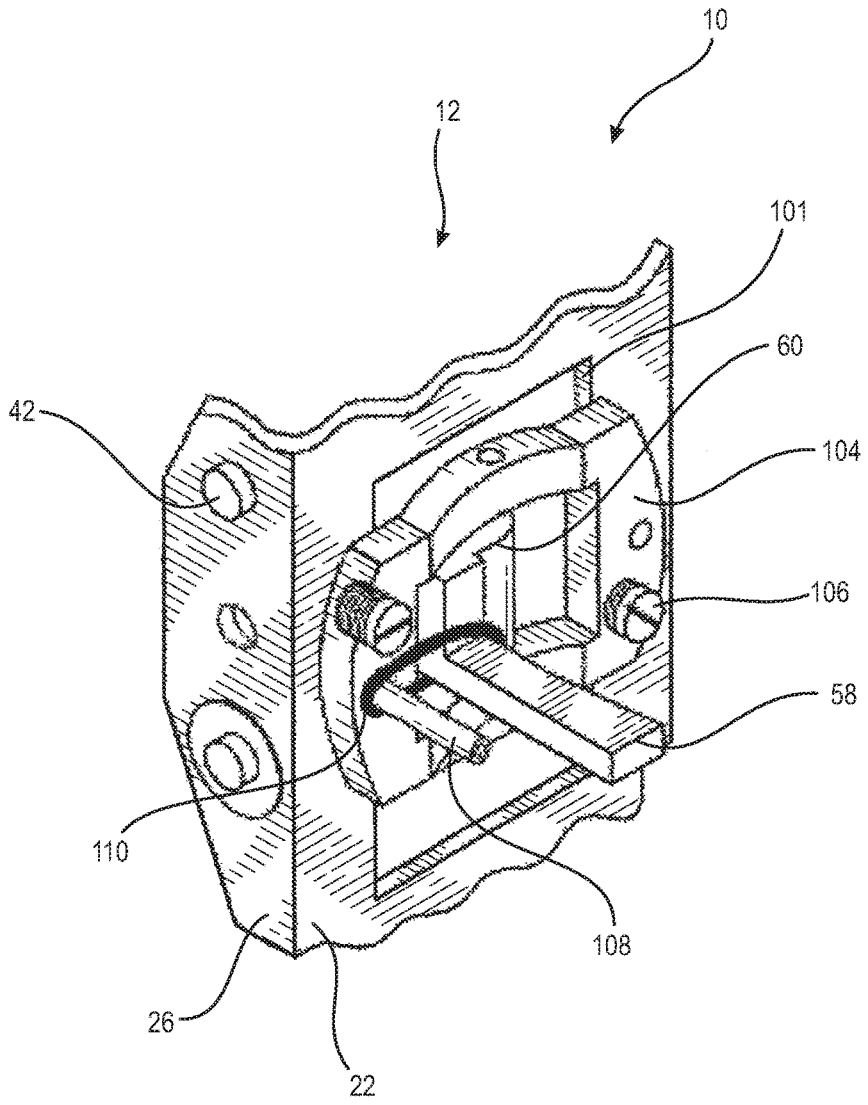
FIG. 5 is an enlarged fragmentary rear perspective view of the present mounting plate.

Included on the latch cylinder 44 is a latch cylinder opening 56 configured to receive a finger 58 of the door handle assembly 12. The finger 58 is attached to a pivoting cam 60 (FIG. 5). While in the preferred embodiment, the finger 58 and the cam 60 are integrally formed, as by casting, other fabrication techniques, including separate finger and cam attached during assembly, are contemplated. On the inside barrel 48, a corresponding inside barrel opening 62 is in registry with the latch cylinder opening 56 when the bolt assembly 15 is in the latched or rest position. Movement of the finger 58 in the openings 56, 62, causes the inside barrel 48 to laterally slide relative to the outside barrel 46 and open the latch to a released or retracted position by retracting a strike 64 relative to the dress plate 50. It has been found that the sliding movement of the inside barrel 48 relative to the outside barrel 46 is one source of the objectionable noise levels of conventional door latch assemblies.

More specifically, the strike 64 is held in place by being crimped into an open end 66 of the inside barrel at the point of an annular groove 68. The strike 64 also includes a groove 70 constructed and arranged to accommodate a roll pin 72 used to attach the inside barrel 48 to the outside barrel, at the same time accommodating movement of the inside barrel between the latched and a retracted position.

Opposite the strike 64, the inside barrel 48 defines a spring recess 74 dimensioned for accommodating a return spring 76 which biases the inside barrel 48 to the latched position in which the strike 64 projects from the door 30 as seen in FIG. 1. The spring 76 is held in place by engaging an end plug 78 that is in turn secured to an end of the outside barrel 46 using a spring roll pin 80. In the extended position of the strike 64, a recessed shoulder 82 of the strike engages an inside surface 84 of the dress plate 50 to define a farthest extent of the extension of the inside barrel 48 relative to the outside barrel 46. Contact of the strike shoulder 82 against the dress plate 50 has been found to be another source of excessive noise generated by conventional door latch assemblies.

In addition, an anvil plate 86 is fixed to the inside barrel 48 and defines one end of the inside barrel opening 62, and also retains the return spring 76 in the spring recess 74 opposite the end plug 78. As is known in the art related to low profile latch assemblies, the finger 58 of the door handle assembly 12 moves laterally along the axis of the inside barrel 48 within the inside barrel opening 62 when the door handle 22 is moved from the rest position to the actuating position. The finger 58 makes contact with the anvil plate 86 when moving laterally, overcoming the biasing action of the return spring 76 and retracting the strike 64 along with the rest of the inside barrel 48. In addition to the other sources described above, it has been found that noise is also generated through the action of the finger 58 against the anvil plate 86.

Referring again to FIG. 4, as discussed above, it has been recognized that a problem of conventional door latch and door handle assemblies, particularly the low profile type, is that they generate relatively excessive noise over the ambient noise. A feature of the present door latch assembly 10, is one or more acoustic isolators that dampen sound generated by different parts of the door latch assembly. In general, the acoustic isolators are positioned to acoustically isolate points of contact.

In the preferred embodiment, the door bolt assembly 15 includes several acoustic isolators. At least one barrel acoustic isolator 90 is disposed on the inside barrel 48 for isolating sound generated by the reciprocating action of the inside barrel. Preferably, a pair of isolators 90, which in the preferred embodiment are O-rings made of rubber or other known resilient material, are placed at or near each end of the inside barrel 48. More preferably, one isolator is placed near the junction of the strike 64 and the inside barrel 90. At the opposite end of the inside barrel 48, a second isolator 90 is placed at the junction of the end plug 78 and the inside barrel. The isolators 90 reduce the contact between inside barrel 48 and the outside barrel 46. In addition, the isolators 90 guide the reciprocating movement of the inside barrel 48 relative to the outside barrel 46 between the latch and release positions, and maintain a slight separation between the two barrels, in the general range of 0.020 inch, which may vary to suit the application.

In addition, the acoustic isolators alternately include one or more stabilizers 91, each of which is disposed exteriorly on the inside barrel 48 to reduce respective sliding contact between the outside barrel 46 and inside barrel. In one embodiment, the stabilizers 91 are polymeric spacers fixed to the inside barrel 48 to project radially from the inside barrel exterior and a pair of the stabilizers are diametrically located on the exterior of the inside barrel 48. The shape, number and position of the stabilizers 91 may vary to suit the situation, and, similarly to the isolators 90, are configured for reducing the area of contact made between the inside barrel 46 and the outside barrel 48, and thus dampening the sound generated by the present door latch assembly 10.

Also included on the door bolt assembly 15 is a strike acoustic isolator 92. This generally "D"-shaped component 92 is also made of rubber or similar resilient material, and is fixed, by chemical adhesive or the like, in the recessed shoulder 82 of the strike. Thus, the strike acoustic isolator 92 will contact the dress plate 50 to acoustically isolate these components. To further reduce noise of the strike 64, a strike pad 94 is held in place on an angled surface 96 of the strike in a pad groove 98, using a dovetail configuration with or without chemical adhesive, as is known in the art. The strike pad 94 is preferably made of nylon, rubber or other resilient, durable material.

Another acoustic isolator 100 is designated an anvil acoustic isolator, and is positioned on the anvil plate 86 within the inside barrel opening 62. The isolator 100 is held in place with chemical adhesive or the like, and is made of rubber or other suitable material. As such, the anvil acoustic isolator 100 receives the finger 58 and thus isolates the finger from the anvil plate 86.

Figure 6:
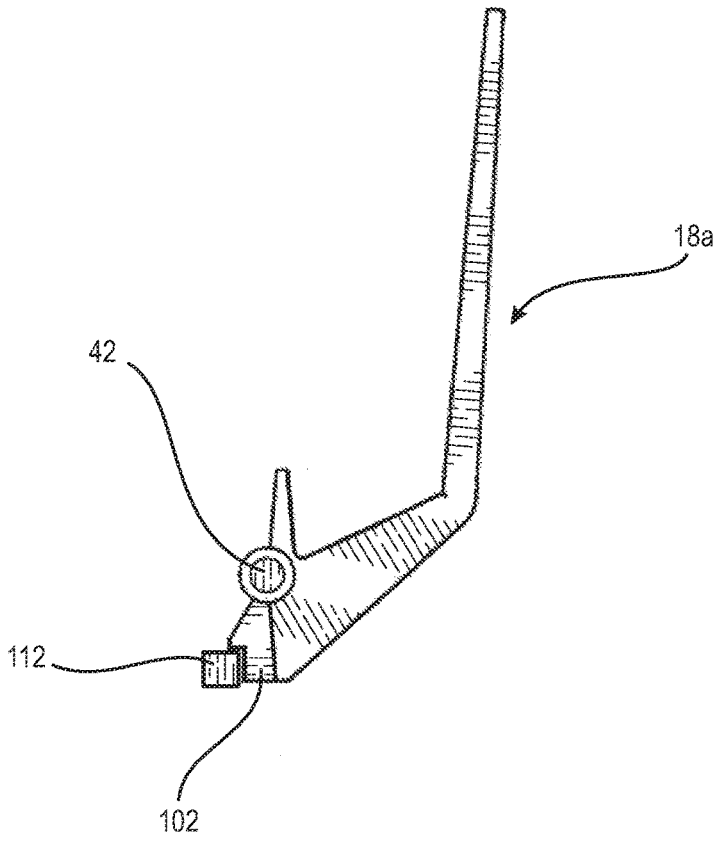
FIGS. 6-7 are side views of a pull door handle suitable for use with the present latch assembly.

Referring now to FIGS. 1, 5 and 6, the finger 58 protrudes substantially perpendicularly to a main plane defined by the mounting plate 22. As is known in the art, the finger 58 also includes the cam 60 activated by motion of the door handle 18 so that the finger moves in a lateral or side-to-side motion. Further, the cam 60 is at least partially disposed in a main mounting plate opening 101. During operation of the door handle assembly 12, the door handle 18 is either pushed or pulled, depending on the needs of the application. When the door handle 18 is in operation, an actuation end 102 of the door handle 12 engages the cam 60, causing the finger 58 coupled to the cam to move laterally along the longitudinal axis of the latch cylinder 44 within the latch cylinder opening 56 and the inside barrel opening 62, engaging the latch cylinder 56 such that the strike 64 is retracted and the door 30 can be opened.

A screw plate 104 is secured to the mounting plate 22 using fasteners 106. The screw plate 104 holds the cam 60 in position in the mounting plate opening 101. A pin 108 is coupled to, and protrudes from, the screw plate 104 and is substantially parallel to the finger 58 when the finger is in the rest position as seen in FIG. 5, which represents the latched position of the door bolt assembly 15. In conventional door latch assemblies, when the door handle 18 moves back and forth from the actuating position to the rest position thereby causing the finger 58 to move laterally, the finger may generate sound by making contact through movement relative to the screw plate 104. Thus, the present door handle assembly 12 includes a finger acoustic isolator 110 associated with, and preferably secured around the finger 58 as well as the pin 108. Other connections between the isolator 110 and the finger 58 are contemplated. By biasing the finger 58 relative to the screw plate 104 in any direction, the finger acoustic isolator 110 dampens sound generated by the finger 58 moving loosely or laterally along the axis of the inside barrel 48. In other words, the finger acoustic isolator 110 prevents unwanted vibration or movement of the finger 58 relative to the screw plate 104. In the preferred embodiment, the finger acoustic isolator 110 biases the finger 58 laterally or towards, or in the direction of the pin 108, however other biasing directions are contemplated. In the event the pin 108 is absent, it is also contemplated that the finger acoustic isolator 110 is anchored on another portion of the screw plate 104 or other attachments to the screw plate. In the preferred embodiment, the finger acoustic isolator 110 is an O-ring made of rubber or any other resilient material with similar properties. Other types of biasing devices, including but not limited to springs or loop-type biasing members are contemplated as the finger acoustic isolator 110.

Figure 7:
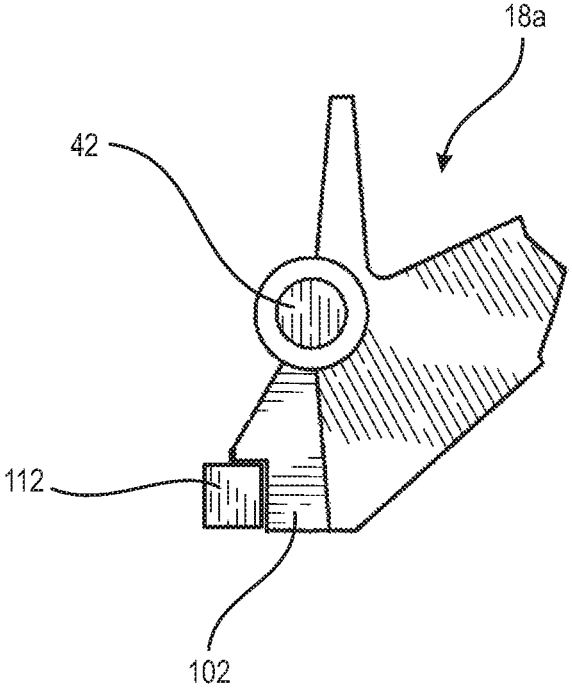

Referring to FIGS. 6-7, an embodiment of a door handle 18 of the pull type is designated 18*a* is shown that can be used in the door handle assembly 12. The pull handle 18*a* is coupled to the pivot pin 42 as described above, which is also secured to the mounting plate 22. Further, the pull handle 18*a* has the actuation end 102 engaging the cam 60. It has been found that a still further source of excessive noise is generated when the handle 18*a* strikes the mounting plate 22 upon release by the user. Accordingly, another acoustic isolator is provided in the form of a block-like handle isolator 112 secured, as by mechanically, chemical adhesive or the like, to the handle 18*a*. The handle acoustic isolator 112 is preferably made of rubber or similar resilient material.

Figure 8:
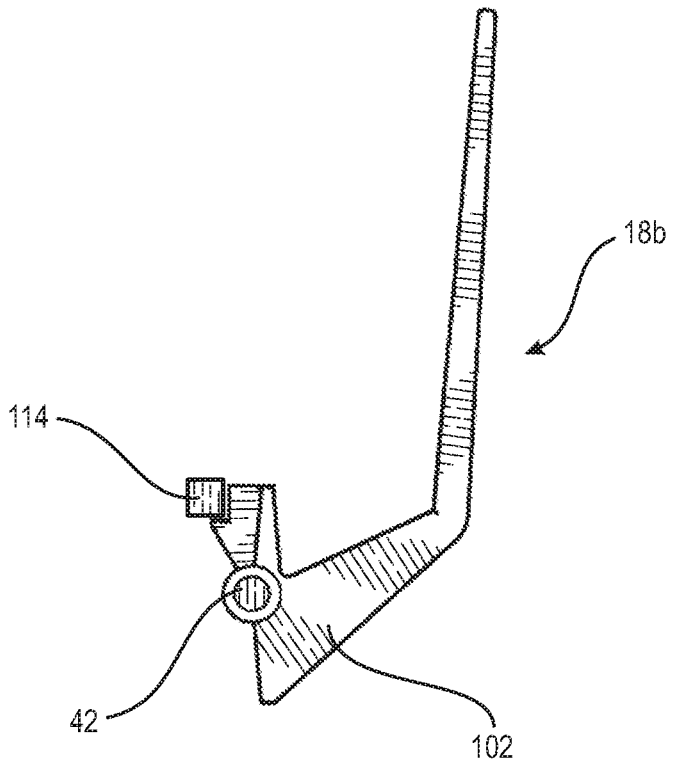
FIGS. 8-9 are side views of a push door handle suitable for use with the present latch assembly.
Figure 9:
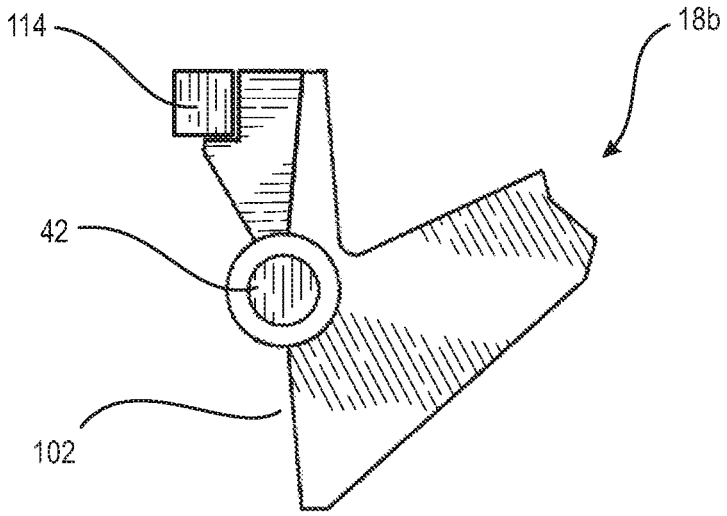

Referring now to FIGS. 8-9, an embodiment of door handle 18 in a push-type style is designated 18*b*. Shared components with the hands 18 and 18*a* are designated with identical reference numbers. A handle acoustic isolator 114 similar, if not identical in construction and orientation to the isolator 112 is secured to the push handle 18*b* and is configured to dampen sound generated by the push handle moving between the rest position and actuating position thereby making contact with the mounting plate 22.

The acoustic isolators 90, 92, 94, 100, 110, 112 and 114 of the door latch assembly 10, individually or in combination, dampen sound generated by the door latch assembly such that an increase in sound over ambient noise (which can range from 40 to 42 decibels) is substantially reduced compared to conventional latch assemblies, which add up to 30 decibels over ambient noise in a hospital room.

One of ordinary skill in the art may characterize ambient noise level (also called background noise level, reference sound level, room noise level, etc.) as the background sound pressure level at a given location, normally specified as a reference level to some other new intrusive sound source. In addressing one of the goals of the present latch, to reduce operational noise of door latches, the noise introduced by the present latch assembly 10 was measured to determine a level of sound introduced over the ambient noise level. Such test measurements were conducted in 50 increments of 10 second intervals on depression and spring back of the paddle of a test door handle (the total test lasting 9.6 minutes). Test measurements were performed using a plunger activation device, a Koolertron Digital Sound Level Meter, and a fixed mounting board for the tested door latches. In addition to measuring the noise introduced by the present latch assembly 10, sound level measurements of conventional latches were also measured.

The test results disclosed that the mean ambient sound level was 44.172 decibels, ranging from about 41 decibels to about 46 decibels. The mean sound level of the noise over ambient introduced by the present latch assembly 10 is about 0.01 decibels. In contrast, conventional door latch assemblies introduced a mean sound level of noise over ambient from about 29 to about 35 decibels. Embodiments of the present door latch assembly 10 were shown to dampen sound generated by movement of the door latch assembly to about 15 decibels to 0.01 decibels over the ambient noise level. Further embodiments dampen sound generated by movement of the door latch assembly ranged from about 10 decibels to 0.01 decibels over the ambient noise level. Additional embodiments dampen sound generated by movement of the door latch assembly ranged from about 5 decibels to 0.01 decibels over the ambient noise level.

The test measurements also found that the acoustic isolators of the door latch assembly 10, individually or in combination, dampen sound generated by the door latch assembly such that an increase in sound over the ambient noise level (which can range from 40 to 45 decibels) is less than about 37% to 0.022% of the ambient noise level. It is also contemplated that the increase over ambient noise by the operation of the present latch assembly 10 is about 25% to 0.022%. It is further contemplated that the increase over ambient noise by the operation of the present latch assembly 10 is about 12% to 0.022%. While particular embodiments of the present door latch assembly with low operating noise has been described herein, it will be appreciated by those skilled in the art that changes and modifications may be made without departing from the invention in its broader aspects and as set forth in the following claims.

The invention claimed is:

1. A door latch assembly with enhanced acoustic dampening characteristics, comprising:

said door latch assembly including at least one door handle assembly connected to a door bolt assembly, said door handle assembly including a pivoting handle, said door bolt assembly including:

an inside barrel;

an outside barrel configured for accommodating axial reciprocal sliding action of said inside barrel between a latch position and a release position caused by movement of said at least one handle assembly acting against a biasing force created by a return spring connected to said inside barrel, said pivoting handle movement causing reciprocal movement of a strike connected to said inside barrel relative to said outside barrel;

at least one barrel acoustic isolator associated with said inside barrel and movable therewith, being located between the inside barrel and the outside barrel, and configured for dampening sound generated by said reciprocal action;

a finger;

a door handle coupled to the finger such that the finger moves laterally along the axis of the inside barrel when the door handle is moved from a rest position to an actuating position;

an anvil plate coupled to the inside barrel for moving the inside barrel to a release position;

an anvil acoustic isolator being separate from said at least one barrel acoustic isolator and being fastened to a finger-receiving surface of the anvil plate and configured for dampening sound generated by the finger making contact with the anvil acoustic isolator; and the door handle assembly includes a screw plate, a finger acoustic isolator associated with and looped around the finger and a portion of the screw plate, being separate from said at least one barrel acoustic isolator and said anvil acoustic isolator, and being configured for dampening sound generated by the finger moving laterally along the axis of the inside barrel.

2. The door latch assembly of claim 1, wherein the door bolt assembly includes:

said strike coupled to the inside barrel and having a shoulder;

a dress plate coupled to the outside barrel and disposed for receiving the strike; and a strike acoustic isolator secured to the shoulder configured for dampening sound generated by the strike making contact with the dress plate, said strike acoustic isolator being separate from said at least one barrel acoustic isolator.

3. The door latch assembly of claim 1, wherein the door bolt assembly includes:

said return spring retained in the inside barrel for biasing the inside barrel relative to the outside barrel in the latch position;

an end plug secured to the outside barrel for retaining the spring; and in addition to the at least one barrel acoustic isolator, further including an end plug acoustic isolator secured to the end plug and configured for dampening sound generated by said biasing of the inside barrel.

4. The door latch assembly of claim 1, further comprising a door handle assembly including:

a mounting plate; and a door handle pivotably attached to the mounting plate;

a handle acoustic isolator secured to the door handle, being separate from said at least one barrel acoustic isolator, and configured for dampening sound generated by the door handle making contact to the mounting plate when moving from at least one of a rest position to an actuating position and the actuating position to the rest position.

5. The door latch assembly of claim 1, further including said finger acoustic isolator being separate from said at least one barrel acoustic isolator, wherein at least one of the at least one barrel acoustic isolators, and said finger acoustic isolator is an O-ring.

6. The door latch assembly of claim 1, further including at least one of said anvil acoustic isolator, a strike acoustic isolator, and a handle acoustic isolator is a resilient pad, said anvil, strike and handle acoustic isolators being separate from said at least one barrel acoustic isolator.

7. The door latch assembly of claim 1, wherein said at least one acoustic isolator is constructed and arranged on the door latch assembly to dampen sound generated by the door latch assembly such that an increase in sound over ambient noise is less than 5 decibels.

8. The door latch assembly of claim 1, wherein said at least one acoustic isolator is constructed and arranged on the door latch assembly to dampen sound generated by the door latch assembly such that an increase in sound over ambient noise is less than 12.5% of the ambient noise.

9. A door latch assembly with enhanced acoustic dampening characteristics, comprising:

a door bolt assembly including:

an inside barrel;

an outside barrel configured for accommodating reciprocal sliding action of the inside barrel between a latch position and a release position;

at least one circular acoustic isolator associated with and located between the inside barrel and the outside barrel, and configured for guiding the inside barrel in the outside barrel when accommodating the reciprocal sliding action of the inside barrel to reduce contact between the inside barrel and the outside barrel, thereby dampening sound generated by said reciprocal action;

a finger;

a door handle coupled to the finger such that the finger moves laterally along the axis of the inside barrel when the door handle is moved from a rest position to an actuating position;

an anvil plate coupled to the inside barrel for moving the inside barrel to a release position;

an anvil acoustic isolator being separate from said at least one barrel acoustic isolator and being fastened to a finger-receiving surface of the anvil plate and configured for dampening sound generated by the finger making contact with the anvil acoustic isolator; and the door handle assembly includes a screw plate, a finger acoustic isolator associated with and looped around the finger and a portion of the screw plate, being separate from said at least one barrel acoustic isolator and said anvil acoustic isolator, and being configured for dampening sound generated by the finger moving laterally along the axis of the inside barrel.

10. A door latch assembly with enhanced acoustic dampening characteristics, comprising:

a door bolt assembly including:

an inside barrel;

an outside barrel configured for accommodating reciprocal, axial sliding action of the inside barrel between a latch position and a release position;

at least one barrel acoustic isolator associated with located between the inside barrel and the outside barrel, and configured for dampening sound generated by said reciprocal action;

an anvil plate secured inside the inside barrel and having a finger-receiving surface;

a door handle assembly including:

a finger moving laterally relative to a screw plate;

a door handle coupled to the finger such that the finger moves laterally along the axis of the inside barrel when the door handle is moved from a rest position to an actuating position;

a finger acoustic isolator secured around the finger and a portion of said screw plate to retain the finger when the door handle is in the rest position and configured for dampening sound generated by the finger moving laterally along the axis of the inside barrel, wherein the inside barrel is configured for receiving the finger at the finger-receiving surface of the anvil plate;

an anvil plate coupled to the inside barrel for moving the inside barrel to a release position;

an anvil acoustic isolator being separate from said at least one barrel acoustic isolator and being fastened to a finger-receiving surface of the anvil plate and configured for dampening sound generated by the finger making contact with the anvil acoustic isolator; and the door handle assembly includes a screw plate, said finger acoustic isolator associated with and looped around the finger and a portion of the screw plate, being separate from said at least one barrel acoustic isolator and said anvil acoustic isolator, and being configured for dampening sound generated by the finger moving laterally along the axis of the inside barrel.

11. The door latch assembly of claim 10, the door bolt assembly includes an anvil acoustic isolator fastened to a finger-receiving surface of the anvil plate and configured for dampening sound generated by the finger making contact with the anvil acoustic isolator.

12. The door latch assembly of claim 11, wherein said door latch assembly is constructed and arranged to generate between 0.01 and 15 decibels over ambient noise.

13. A door latch assembly with enhanced acoustic dampening characteristics, comprising:

a door bolt assembly including;

a latch cylinder having a latch cylinder opening and a reciprocating strike;

a door handle assembly including:

a finger; and a door handle coupled to the finger such that the finger is moved in the latch cylinder opening when the door handle is moved from a rest position to an actuated position, the finger is configured for biasing the latch cylinder from a latch position to a release position;

at least one acoustic isolator configured for dampening sound generated by the door latch assembly due to movement by at least one of the door handle, finger, and latch cylinder, said at least one acoustic isolator including a first isolator located between an inside barrel and an outside barrel for reducing sound generated through reciprocal sliding action of said inside barrel relative to said outside barrel, a second isolator located on said finger and a portion of a screw plate to reduce sound generated through transverse action of said finger, a third acoustic isolator located on an anvil in said inside barrel to reduce sound generated by impact of said finger on said anvil; and said door latch assembly is constructed and arranged to generate between 0.01 and 15 decibels over ambient noise;

a finger;

a door handle coupled to the finger such that the finger moves laterally along the axis of the inside barrel when the door handle is moved from a rest position to an actuating position;

an anvil plate coupled to the inside barrel for moving the inside barrel to a release position;

an anvil acoustic isolator being separate from said at least one barrel acoustic isolator and being fastened to a finger-receiving surface of the anvil plate and configured for dampening sound generated by the finger making contact with the anvil acoustic isolator; and the door handle assembly includes a screw plate, a finger acoustic isolator associated with and looped around the finger and a portion of the screw plate, being separate from the said at least one barrel acoustic isolator and said anvil acoustic isolator, and being configured for dampening sound generated by the finger moving laterally along the axis of the inside barrel.

14. A tubular door bolt with enhanced acoustic dampening characteristics, comprising:

an inside barrel;

an outside barrel configured for accommodating reciprocal sliding action of the inside barrel between a latch position and a release position; and at least one barrel acoustic isolator associated with, surrounding and mounted to the inside barrel for common movement, and configured for dampening sound generated by said reciprocal action;

a finger;

a door handle coupled to the finger such that the finger moves laterally along the axis of the inside barrel when the door handle is moved from a rest position to an actuating position;

an anvil plate coupled to the inside barrel for moving the inside barrel to a release position;

an anvil acoustic isolator being separate from said at least one barrel acoustic isolator and being fastened to a finger-receiving surface of the anvil plate and configured for dampening sound generated by the finger making contact with the anvil acoustic isolator; and the door handle assembly includes a screw plate, a finger acoustic isolator associated with and looped around the finger and a portion of the screw plate, being separate from said at least one barrel acoustic isolator and said anvil acoustic isolator, and being configured for dampening sound generated by the finger moving laterally along the axis of the inside barrel.

15. The tubular door bolt of claim 14, further including:

a strike coupled to the inside barrel and having a shoulder;

a dress plate coupled to the outside barrel and disposed for receiving the strike; and a strike acoustic isolator secured to the shoulder configured for dampening sound generated by the strike making contact with the dress plate, said strike acoustic isolator being separate from said at least one barrel acoustic isolator.

16. The tubular door bolt of claim 14, further including:

a spring retained in the inside barrel for biasing the inside barrel relative to the outside barrel in the latch position;

an end plug secured to the outside barrel for retaining the spring; and the at least one barrel acoustic isolator including an end plug acoustic isolator secured to the end plug and configured for dampening sound generated by said biasing of the inside barrel.

17. The tubular door bolt of claim 14, wherein the at least one barrel acoustic isolator includes a guiding acoustic isolator secured between the strike and the inside barrel and configured for dampening sound generated by the reciprocal sliding action relative to the outside barrel.

* * * * *